United States Patent [19]

Mosiewicz

[11] Patent Number: 4,715,784

[45] Date of Patent: Dec. 29, 1987

[54] BLADE SUPPORT HUB FOR AN AXIAL FAN

[75] Inventor: Antonio Mosiewicz, Milan, Italy

[73] Assignee: Cofimco S.p.A., Milan, Italy

[21] Appl. No.: 580,061

[22] Filed: Feb. 14, 1984

[30] Foreign Application Priority Data

Mar. 9, 1983 [IT] Italy ..... 19975 A/83

[51] Int. Cl.[4] ..... F04D 29/34

[52] U.S. Cl. ..... 416/208; 416/164; 416/214 R; 416/244 R; 29/156.8 R; 29/557

[58] Field of Search ..... 416/207, 208, 214 R, 416/214 A, 164, 244 R; 29/156.8 R, 557, 445, 463

[56] References Cited

U.S. PATENT DOCUMENTS

| | | | |
|---|---|---|---|
| 367,595 | 8/1887 | Clark | 416/208 |
| 1,832,075 | 11/1931 | Wilson | 416/164 |
| 2,450,660 | 10/1948 | Hardy | 29/156.8 R |
| 2,601,969 | 7/1952 | Eastman | 416/217 |
| 2,856,152 | 10/1958 | Kishline | 416/219 |
| 2,939,536 | 6/1960 | Kearns, Jr. | 416/208 |
| 3,130,677 | 4/1964 | Liebhart | 416/208 |
| 3,294,175 | 12/1966 | Bonder | 416/207 |
| 3,567,340 | 3/1971 | Schneider et al. | 416/208 |
| 3,930,332 | 1/1976 | Seefluth | 416/214 R |
| 4,230,645 | 10/1980 | Dodson | 29/527.6 |
| 4,252,751 | 2/1981 | Shito | 416/208 |
| 4,265,591 | 5/1981 | Gurbin | 416/208 |

FOREIGN PATENT DOCUMENTS

| | | | |
|---|---|---|---|
| 704789 | 3/1941 | Fed. Rep. of Germany | 416/214 |
| 829970 | 1/1952 | Fed. Rep. of Germany . | |
| 872816 | 2/1953 | Fed. Rep. of Germany | 416/214 |
| 1963922 | 6/1971 | Fed. Rep. of Germany | 416/214 A |
| 6701215 | 1/1967 | Netherlands | 416/214 |
| 109864 | 11/1940 | Sweden | 416/214 A |
| 359350 | 10/1931 | United Kingdom | 416/214 A |
| 638856 | 6/1950 | United Kingdom . | |
| 1085344 | 9/1967 | United Kingdom | 416/208 |
| 1511732 | 5/1978 | United Kingdom | 416/208 |
| 461018 | 3/1975 | U.S.S.R. | 416/207 |

*Primary Examiner*—Abraham Hershkovitz
*Assistant Examiner*—John T. Kwon
*Attorney, Agent, or Firm*—Stevens, Davis, Miller & Mosher

[57] ABSTRACT

A blade support hub of hollow circular ring structure for an axial fan, constituted essentially of two opposing parts rigidly fixed together by bolts, the hollow circular ring structure being provided with circular cavities for inserting the fan blade shank, the bolts for joining together the two parts of the hub also serving for fixing all the blade shanks.

7 Claims, 6 Drawing Figures

BLADE SUPPORT HUB FOR AN AXIAL FAN

This invention relates to a blade support hub of hollow circular ring structure for an axial fan, and constituted essentially by two opposing facing parts which are fixed rigidly together by bolts.

Each of the two parts comprises on its inner face, as essential structural elements, an inner rim corresponding to the minor diameter of the circular ring and an outer rim corresponding to the major diameter of the ring.

In assembling the two parts of the hub, their rims perfectly coincide to form the hollow circular ring structure. Said circular ring comprises cavities both in the outer rim and inner rim, to constitute the seats for the blade shanks.

The hub according to the invention can carry two or more blades.

One embodiment of the invention in the form of a hub for four blades is described in detail hereinafter in which, by way of example and not of limitation:

Figure 5:
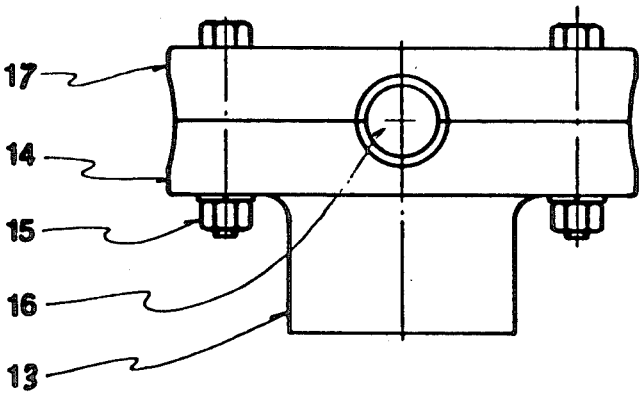
FIG. 5 is an elevational view of the assembled hub.

FIG. 5 is an outer side view of the hub constituted by the lower part 14 and upper part 17 fixed together, and comprising a blade shank insertion cavity 16 shown in a frontal position, the fixing bolts 15, and the cylindrical portion 13 for mounting on the drive shaft.

Figure 1:
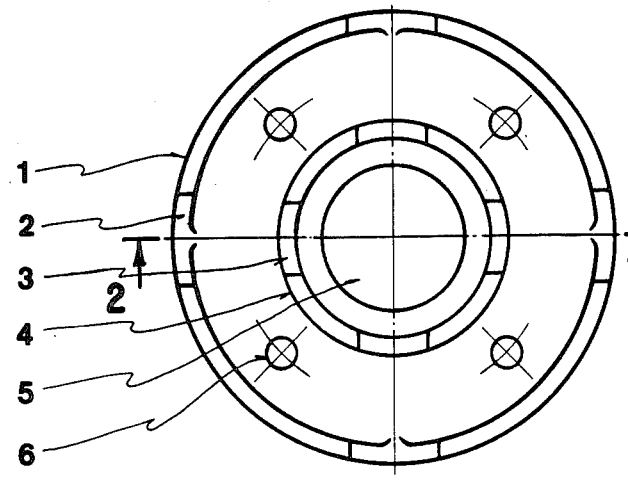
FIG. 1 is a plan view of the upper part of the support hub of this invention.

FIG. 1 shows the upper part of the hub, comprising:

the outer rim 1 with a semicircular cavity 2 the inner rim 4 with a semicircular cavity 3 a central axial aperture 5 of diameter less than the diameter of the inner rim 4 but greater than the diameter of the drive shaft on which the hub is mounted bores 6 for the bolts for attachment to the lower part.

Figure 4:
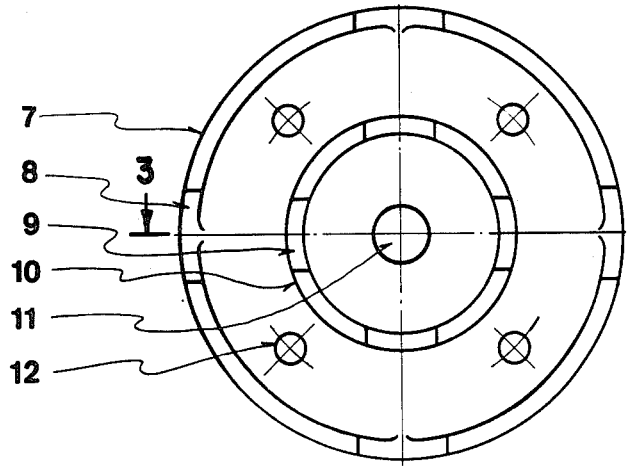
FIG. 4 is a plan view of the lower part of the support hub of this invention.

FIG. 4 shows the lower part of the hub, comprising:

the outer rim 7 with a semicircular cavity 8

The inner rim 10 with a semicircular cavity 9 a central axial bore 11 for mounting on the drive shaft bores 12 for the bolts for attaching to the upper part the cylindrical portion 13 for mounting on the drive shaft.

Figure 2:
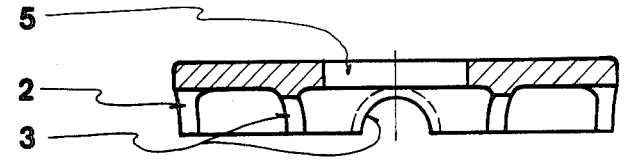
FIG. 2 is a sectional view along line 2—2 of FIG. 1.
Figure 3:
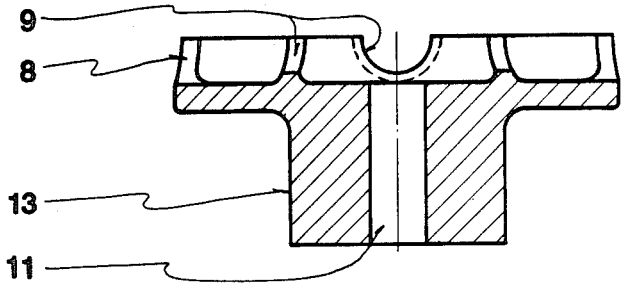
FIG. 3 is a sectional view along line 3—3 of FIG. 4.

FIGS. 2 and 3 are sections through the hub on a central vertical plane, the reference numerals being the same as in FIGS. 1 and 4.

Figure 6:
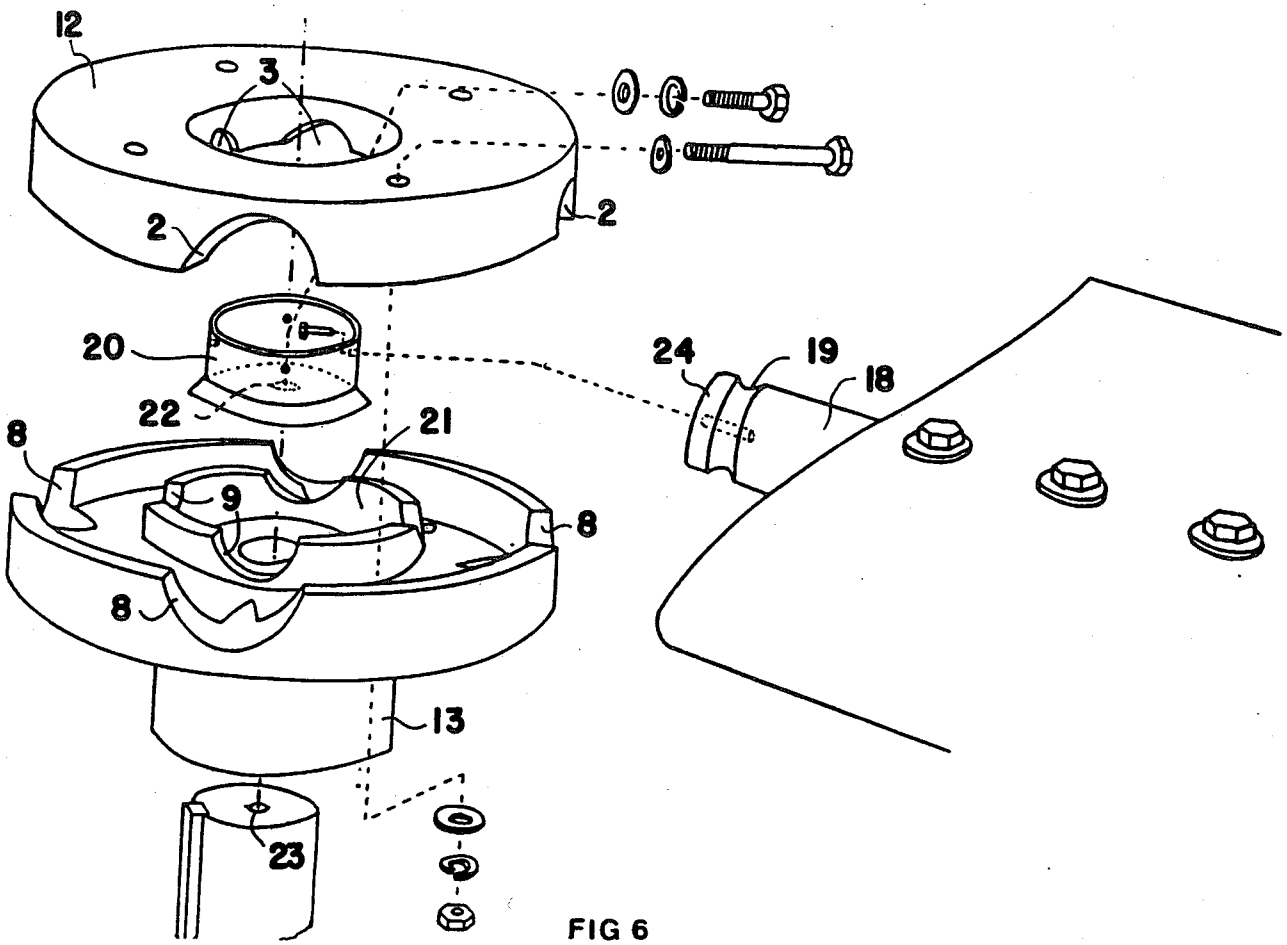
FIG. 6 is an exploded perspective view including an example of the type of propeller blade shank for use with the invention.

It can be seen from FIG. 6 that on assembly, the corresponding semicircular cavities 2 with 8 and 3 with 9 in the two parts form a perfectly cylindrical cavity which constitutes the insertion seat for the blade shank.

In a preferred embodiment of the hub, the inner cavity (formed from the semicircular cavities 3 and 9) for housing the blade shank 18 is of smaller diameter than the outer cavity 2, 8, this latter cavity having a diameter equal to that of the blade shank 18.

This enables the blade to be radilly locked by providing the blade shank 18 with an annular groove 19 corresponding to the edge of the inner cavities 3, 9. On assembly, this edge is inserted into said groove 19 to radially lock the blade.

The blades can obviously also be radially locked in any suitable manner which would enable the blade inclination to be varied if required. For example, a locking nut could be screwed on to the end of the blade shank 18, which would be suitably threaded. Alternatively, the blade can be fixed by providing its shank with an annular groove into which the points of locking bolts could be inserted to provide clamping.

From the foregoing description it is apparent that the hub according to the invention differs in terms of its structural characteristics from hubs of the known art. In this respect, these latter mostly have their blades fixed by means of a single U-bolt for each blade. This leads to a more complicated hub structure and a much greater number of parts.

The hub according to the invention comprises essentially only two parts independently of the number of blades to be carried, and all the blade shanks are fixed simultaneously on tightening-down the upper part of the hub by means of the fixing bolts 15.

Furthermore, the hollow circular ring structure results in a reduced weight of the piece, while at the same time ensuring mechanical rigidity by virtue, inter alia, of the fact that the blade shank 18 is supported on points wich are sufficiently spaced-apart, namely the inner rim 3,9 and the outer rim 2,8.

The structure of the hub according to the invention also allows particularly simple and economical construction.

The two essential parts of the hub can be produced from cast steel in order to obtain maximum mechanical properties.

The casting operation presents no difficulties in view of the simple configuration of the pieces, and does not necessitate the use of cast iron as in the case of hubs of the known art of more complicated structure.

The two castings are then rigidly fixed together by bolts, after which the further necessary machining can be easily performed, in particular the milling of the blade shank seat cavitites and the final turning of the axial bores for finishing purposes.

It is apparent that such a machining system allows high dimensional precision and positional accuracy (symmetry) of the blade shank seat cavitites.

A substantial advantage of the hub according to the invention, when constructed by the aforesaid method, is apparent from the following considerations.

In the case of hubs of the prior art, which are generally manufactured by casting, this latter operation is carried out in such a manner that the cast piece already has a more or less definitive shape and dimensions, and in particular with the number and dimensions of the blade shank seats already predetermined.

This requires a large number of specific casting operations in view of the various hub types which are manufactured, and consequently a large number of castings need to be stored.

In contrast, the hub according to the invention allows machining to be carried out on the two basic parts which are subsequently fixed together to form the hollow circular ring structure. The basic parts are cast in a single standard dimension, with the blade shank housing seats being defined in terms of number and dimensions (diameter etc.) only subsequently at the machining stage.

Consequently, only the two basic parts suitable for forming various types of finished hub need be stored, with obvious practical and economical advantages.

The hub according to the present invention affords a system for mounting the same hub on the drive shaft which is very advantageous on account of the mechanical strength and ease of manufacture. Such systems is set forth in FIG. 6 in which one can clearly note that the fixing of the lower part of the hub to the drive shaft is carried out through a cylindrical part 20 inserted in the central cavity 21 of the hub and provided with an axial bore 22 in its base for inserting a bolt which is then screwed in an axial bore 23 of the drive shaft. In this way the cylindrical part 20 holds the hub fixed on the end of the drive shaft. The above said cylindrical part 20 has a lower base of a diameter equal to that of the central cavity 21 of the hub in order to assure a perfect truing of said part in the hub, whereas its cylindrical wall has a smaller diameter in order to allow between the same wall and the internal cylindrical wall of the cavity 21 enough space for the head 24 of the blade shank 18, projecting out from the internal circular cavity 3,9.

The above said cylindrical part 20 for the mounting can also be provided with bores in the side wall for inserting therein bolts which then are screwed axially in the blade shank, forming in this way an additional fixing of the blade.

I claim:

1. A blade support hub of hollow circular ring structure for an axial fan with at least two blades, comprising two facing opposite parts each having an inwardly facing inner rim and an inwardly facing outer rim corresponding respectively to the minor diameter and to the major diameter of said circular ring structure spaced-apart; radially extending blade shank housing seats formed by bored cavities in said circular ring structure which extend through both the outer rim and the inner rim; the diameter of the cavity bore through the inner rim being of smaller diameter than the diameter of the cavity bore through the outer rim, which has the same diameter as the blade shank, the blade shank having an annular groove in a position corresponding to said inner ring for radially locking the blade; bolts for holding the opposite parts together in facing relationship, the blades being positioned so as to be fixed in their cavities all simultaneously upon tightening of the two opposite parts together by means of said bolts.

2. A device for mounting the hub of claim 1 on a drive shaft comprising a cylindrical part of a size and shape to fit into within the inner rim of the hub, said cylindrical part having inner axial bore for holding a bolt which extends outwardly to be threaded into an axial bore in an adjacent drive shaft.

3. A method for manufacturing a blade support hub of hollow circular ring structure having two facing opposite parts, each with an inwardly facing inner rim and an inwardly facing outer rim, comprising the steps of casting the two opposite parts to a standard dimension;

securing the two opposite parts together in facing relationship; and then machining spaced-apart radial extending blade shank opening into the assembled opposite parts in the number and dimensions required.

4. A blade support hub of hollow circular ring structure for an axial fan with at least two blades, comprising two facing opposite parts each having an inwardly facing inner rim and an inwardly facing outer rim corresponding respectively to the minor diameter and to the major diameter of said circular ring structure, said rims having a center of curvature on a center of rotation of said hub; spaced-apart radially extending blade shank housing seats formed by bored cavities in said circular ring structure which extend through both the outer rim and the inner rim; the diameter of the cavity bore through the inner rim being of smaller diameter than the diameter of the cavity bore through the outer rim, which has the same diameter as the blade shank; the blade shank having an annular groove in a position corresponding to said inner ring for radially locking the blade; bolts for holding the opposite parts together in facing relationship, the blades being positioned so as to be fixed in their cavities all simultaneously upon tightening of the two opposite parts together by means of said bolts.

5. A device for mounting the hub ob claim 4 on a drive shaft comprising a cylindrical part of a size and shape to fit within the inner rim of the hub, said cylindrical part having an inner axial bore for holding a bolt which extends axially outwardly to be threaded into an axial bore in an adjacent drive shaft.

6. A blade support hub of hollow circular ring structure for an axial fan with at least two blades, comprising two facing opposite parts each having an inwardly facing inner rim and an inwardly facing outer rim correspnding respectively to the minor diameter and to the major diameter of said circular ring structure, said rims having a center of curvature on a center of rotation of said hub; spaced-apart radially extending blade shank housing seats formed by bored cavitites in said circular ring structure which extend through both the outer rim and the inner rim, said housing seats being radially-spaced apart the same distance for each blade; the diameter of the cavity bore through the inner rim being of smaller diameter than the diameter of the cavity bore through the outer rim, which has the same diameter as the blade shank; the blade shank having an annular groove in a position corresponding to said inner ring for radially locking the blade; bolts for holding the opposite parts together in facing relationship, the blades being positioned so as to be fixed in their cavities all simultaneously upon tightening of the two opposite parts together by means of said bolts.

7. A device for mounting the hub of claim 6 on a drive shaft comprising a cylindrical part of a size and shape to fit within the inner rim of the hub, said cylindrical part having an inner axial bore for holding a bolt which extends axially outwardly to be threaded into an axial bore in an adjacent drive shaft.

* * * * *